US007213702B2

(12) United States Patent
Takimoto et al.

(10) Patent No.: US 7,213,702 B2
(45) Date of Patent: May 8, 2007

(54) SMALL BAG-SHAPED DRUG CONTAINER

(75) Inventors: Hiroaki Takimoto, Osaka (JP); Kenji Omori, Osaka (JP); Minoru Honda, Osaka (JP); Hitoshi Futagawa, Osaka (JP)

(73) Assignee: Nipro Corporation, Osaka-Shi (JP)

( * ) Notice: Subject to any disclaimer, the term of this patent is extended or adjusted under 35 U.S.C. 154(b) by 124 days.

(21) Appl. No.: 10/285,545

(22) Filed: Nov. 1, 2002

(65) Prior Publication Data

US 2003/0080129 A1 May 1, 2003

(30) Foreign Application Priority Data

Nov. 2, 2001 (JP) ..... 2001-337531

(51) Int. Cl.
*B65D 25/08* (2006.01)

(52) U.S. Cl. ..... 206/221; 206/219; 604/408; 604/410; 604/416

(58) Field of Classification Search ..... 604/87, 604/88, 408, 410, 415, 416, 414; 206/219, 206/221; 215/DIG. 8
See application file for complete search history.

(56) References Cited

U.S. PATENT DOCUMENTS 4,608,043 A * 8/1986 Larkin ..... 604/87
4,842,587 A * 6/1989 Poncy ..... 604/198
4,961,495 A * 10/1990 Yoshida et al. ..... 206/219
4,994,056 A * 2/1991 Ikeda ..... 604/410
5,002,530 A * 3/1991 Recker et al. ..... 604/87
5,135,489 A * 8/1992 Jepson et al. ..... 604/48
5,176,634 A * 1/1993 Smith et al. ..... 604/87
5,184,742 A * 2/1993 DeCaprio et al. ..... 215/356
5,409,125 A 4/1995 Kimber et al.
5,423,421 A * 6/1995 Inoue et al. ..... 206/219
5,944,709 A * 8/1999 Barney et al. ..... 604/410
5,957,898 A * 9/1999 Jepson et al. ..... 604/256
5,984,373 A * 11/1999 Fitoussi et al. ..... 285/92
6,068,617 A 5/2000 Richmond
6,149,655 A * 11/2000 Constantz et al. ..... 606/94
6,261,282 B1 * 7/2001 Jepson et al. ..... 604/533
6,267,154 B1 7/2001 Felicelli et al.
6,695,829 B2 2/2004 Hellstrom et al.

(Continued)

FOREIGN PATENT DOCUMENTS

EP 0 941 731 A2 9/1999

(Continued)

OTHER PUBLICATIONS

Value Plastics INC. Luers, Internet Product Drawing LC23, Feb. 1998 and CF210 Sep. 2000.*

(Continued)

*Primary Examiner*—David Fidei
(74) *Attorney, Agent, or Firm*—Birch, Stewart, Kolasch & Birch, LLP

(57) ABSTRACT

A bag-shaped drug container comprises a bag-shaped container body made of a flexible film, and a mouth provided at one end of the container body. The mouth is provided on a side of an open end thereof with a Luer locking means to liquid-tightly connect it with a tip of a syringe, and closed by a closing means such as cap or a male Luer portion.

13 Claims, 4 Drawing Sheets

U.S. PATENT DOCUMENTS

2001/0047162 A1* 11/2001 Yugari ..... 604/410

FOREIGN PATENT DOCUMENTS

| | | |
|---|---|---|
| EP | 1 166 742 A2 | 1/2002 |
| JP | H08-280775 | 10/1996 |
| JP | H10-201820 | 8/1998 |
| JP | 2000-197687 | 7/2000 |
| WO | 99/24086 A1 | 5/1999 |

OTHER PUBLICATIONS

Value Plastics INC. Luers, Internet Product Page from which LC23 and CF210 linked, date unknown.*

* cited by examiner

SMALL BAG-SHAPED DRUG CONTAINER

BACKGROUND OF THE INVENTION

The present invention relates to a small bag-shaped drug container and, more particularly, to a small bag-shaped drug container suitable for almost insoluble or insoluble drugs. Further, the present invention relates to a small bag-shaped drug container, which enables a drug to be easily and completely dissolved or suspended in spite of a small amount of a solution.

Drugs which are easily degenerated by moisture or oxygen have conventionally been administered in the form of a liquid drug prepared just before use by mixing it with a solution. In order to prepare the liquid drug, there have widely been used a so-called syringe method comprising the steps of injecting a solution into a vial containing a dried drug with a syringe, and then drawing the resultant liquid drug into the syringe, or a method employing a double ended needle to communicate a solution container with a drug container. Recently, in order to remove troublesome dispensation, double chamber type prefilled syringes have been put into practical use. Such a prefilled syringe contains a drug in a drug chamber and a solution in a solution chamber, which are adapted to be communicated with one another by communicating means such as a bypass or a built-in connecting needle to dissolve the drug in the solution.

The syringe method is used for preparation of a liquid drug less than about 10 ml, but it is troublesome in dissolving operation. Further, in case that a drug such as a subcutaneous injection is required to be dissolved or suspended in a small amount of the solution, it is extremely difficult to perform the dissolving operation in the vial. In addition, in case of insoluble or substantially insoluble drugs, it is required to repeatedly transfer a mixture of the solid medicine and the solution from the syringe to the vial, or vice versa, in order to achieve complete dissolution or suspension. However, it is very difficult to perform such dissolving operations without producing foaming.

The above troublesome dispensation can be avoided by use of the method of employing a double ended needle or the double-chamber type prefilled syringes. However, it is very difficult with the method of employing a double-ended needle to dissolve insoluble or substantially insoluble drugs in the solution without foaming, since the mixture of the solid medicine and the solution must be repeatedly transferred from the syringe to the vial, or vice versa, in order to achieve dissolution or suspending. Similarly, it is very difficult with the double-chamber type prefilled syringe to perform dissolving operation without foaming since the mixing can be performed only by shaking of the syringe.

SUMMARY OF THE INVENTION

It is therefore an object of the present invention to provide a bag-shaped drug container, which makes it possible to easily and completely dissolve or suspend a drug in a solution even if the drug is almost insoluble or insoluble or even if the dissolution or suspension is carried out with a small amount of the solution, as well as to minimize foaming of the drug solution during dissolving or suspending operation, and to prevent the working site from being soiled with the drug solution at the time of recovery of the dissolved or suspended solution into the syringe.

The above objects of the present invention are solved by constituting a drug container with a flexible bag-shaped container to make it possible to press and rub the drug container with hands, and further providing a mouth of the container with means for fixing a tip of a syringe to the mouth of the container to prevent the syringe from falling off from the mouth of the container during pressing and rubbing.

According to the present invention, there is provided a small bag-shaped drug container comprising a container body formed into a bag with a flexible film and a mouth provided at one end of said body, and a Luer locking means provided at an open end of said mouth and being liquid-tightly connectable to a tip of a syringe.

The above film may be composed of a single layer of polyolefine, or multi-layers including an innermost layer of polyolefine. Further, the film may be a film of water permeability and oxygen permeability, or a film of water impermeability and oxygen impermeability. However, if the film is composed of a single layer film of polyolefine or a film of water permeability and oxygen permeability, it is necessary to package the container in a packaging medium with water impermeability and oxygen impermeability.

The container body may be composed of a front film having water permeability and oxygen-permeability and a rear film having water impermeability and oxygen-impermeability and partitioned into two chambers by an easily peelable tender sealing portion provided at a position close to the mouth, one of two chambers being communicated with the mouth, while other chamber being uncommunicated with the mouth. In this case, the front film of the chamber uncommunicated with said mouth may be provided with an easily peelable, water-impermeable and oxygen-impermeable cover film, and the chamber communicated with the mouth may be charged with a drug.

The terms "water-impermeability and oxygen-impermeability" used herein mean properties that can not be permeated by water and oxygen. The terms "water-permeable and oxygen-permeable" used herein mean properties that can be permeated by water and oxygen and includes the properties that are almost impermeable to water and oxygen.

The present invention will be explained below in detail, making reference to the accompanying drawings, which show, by way of example only embodiments thereof.

DETAILED DESCRIPTION OF THE PREFERRED EMBODIMENTS

Figure 1:
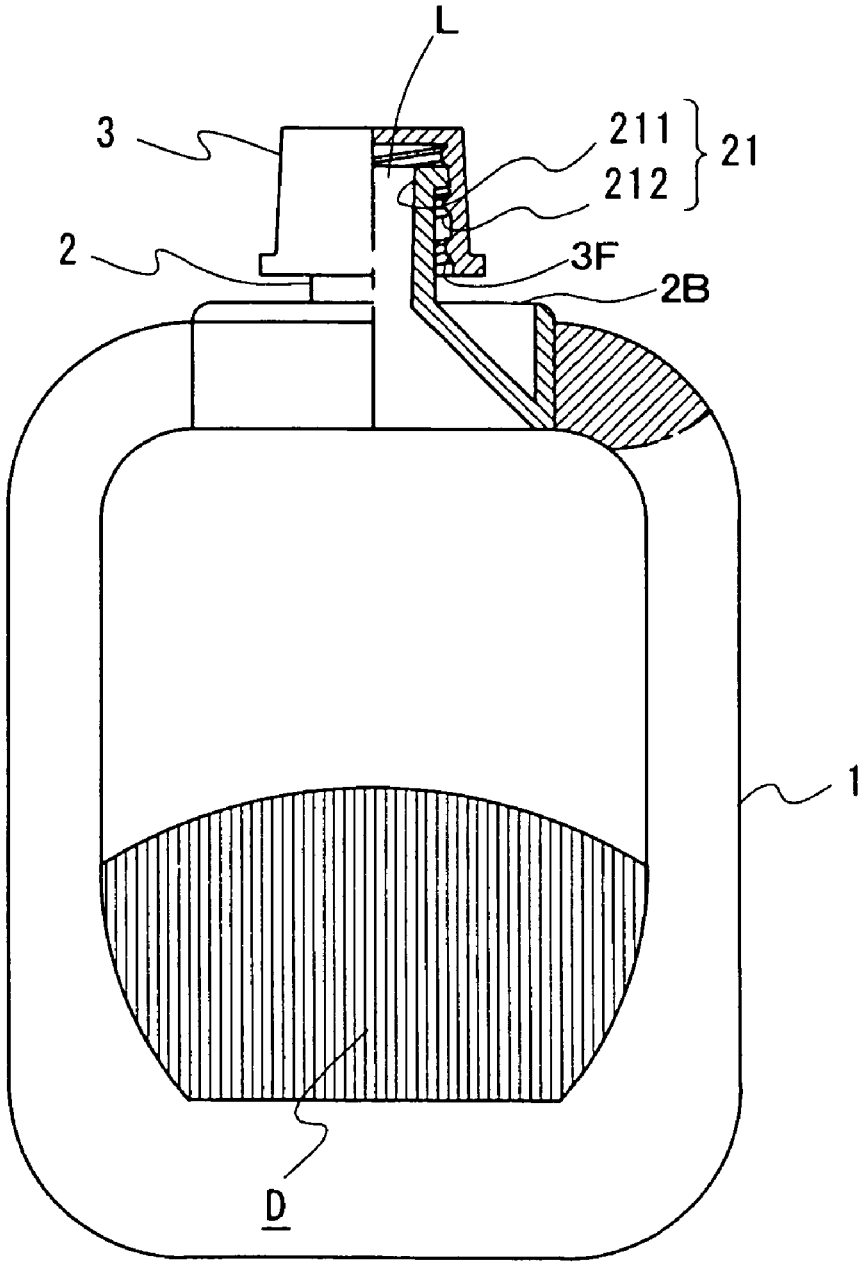
FIG. 1 is a partially cutaway plan view of a bag-shaped drug container illustrating one embodiment of the present invention.

As illustrated in FIG. 1, a bag-shaped drug container of the present invention comprises a bag-shaped container body 1 made of a flexible film, and a mouth 2 with a mouth base 2B provided at one end of the container body 1. The mouth 2 is provided on a side of an open end thereof with a Luer locking means 21 to liquid-tightly connect it with a tip (denoted by a reference sign C in FIG. 4) of a syringe provided at a distal end thereof. The mouth 2 is closed by a closing means such as cap 3 having an internal thread. Alternatively, the mouth 2 may be closed by a male Luer member (not illustrated in the drawings).

The bag-shaped drug container of the present invention is a drug container suitable for use in syringe method widely used for preparation of a drug solution with a small amount of less than about 10 ml. Thus, the container body 1 is so designed to have a capacity of not more than 10 ml and, preferably, not more than 5 ml.

The film that forms the container body 1 may be a single layer film of polyolefine such as polypropylene, polyethylene, polyethylene terephthalate (PET), or a multi-layer film including an innermost layer of polyolefine. The film may be permeable to water and oxygen or impermeable to water and oxygen. Preferred multi-layer films include laminated films comprising a deposited silica layer which is almost impermeable to moisture or oxygen, or aluminum foil-laminated films laminated with a water-impermeable and oxygen-impermeable aluminum foil. The laminated films including a deposited silica layer comprises, for example, multilayer films including an outermost layer of a copolymer of polyethylene (PE) and polypropylene (PP) and an innermost layer of polyethylene, and having a structure of (PE+PP)/$SiO_2$/PET/$SiO_2$/PE. In that case, the outermost layer may be of polyethylene. Preferred aluminum foil-laminated films comprises, for example, multilayer films including an outermost layer of polyethylene terephthalate and an innermost layer of polyethylene and having a structure of PET/aluminum foil/PE. In that case, one or more other plastic layers may lie between aluminum foil and PE.

Figure 2:
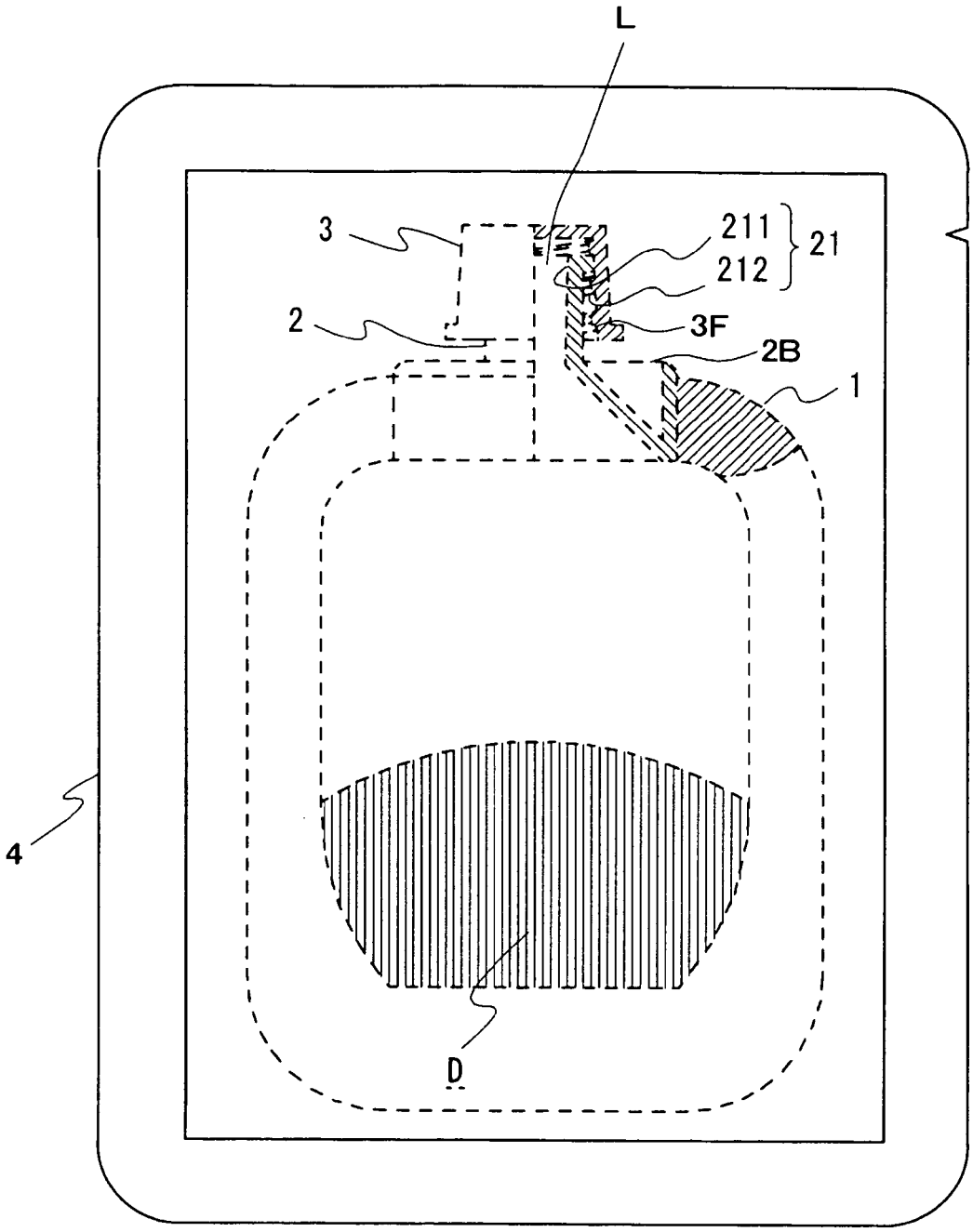
FIG. 2 is a partially cutaway plan view illustrating the bag-shaped drug container of FIG. 1 packaged in a packaging medium.

If the film is a single layer film of polyolefine or a film with water-permeability and oxygen-permeability, the whole container is required to be packaged in a water-impermeable and oxygen-impermeable packaging medium 4, as illustrated in FIG. 2. Preferred packaging medium for this purpose includes, for example, an aluminum foil laminated film having a structure of PET/aluminum foil/PE.

Figure 3:
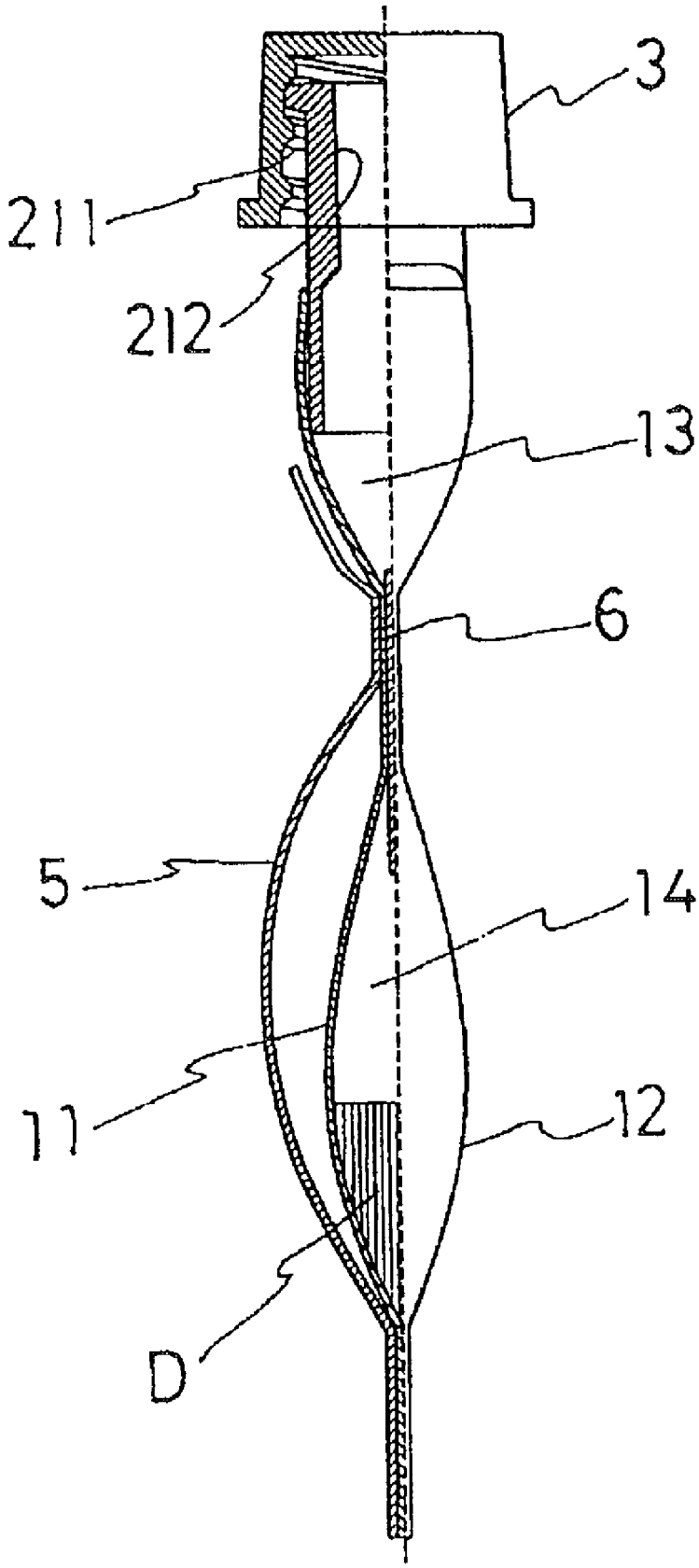
FIG. 3 is a longitudinal cross section of a bag-shaped drug container illustrating another embodiment of the present invention.

The container body 1 may be made of a front film 11 having water-permeability and oxygen-permeability and a rear film 12 having water-permeability and oxygen-permeability, as illustrated in FIG. 3. In this case, the front film 11 is required to be covered with a water-imperable and oxygen-impermeable cover film 5. To this end, the container body 1 is partitioned at a position close to the mouth 2 thereof into two chambers, i.e., a first chamber 13 communicated with the mouth 2 and a second chamber 14 uncommunicated with the mouth 2, by an easily peelable tender sealing portion 6. In this case it is required to use a portion of the front film 11 on the tender sealing portion 6 as a bonding area for the cover film 5. A drug D is contained in the second chamber, i.e., chamber 14 covered with the cover film 5 and uncommunicated with the mouth 2.

The mouth 2 is a cylindrical member generally made of the same resin at that of the innermost layer of the container body 1, and provided at an open end thereof with a Luer locking means 21. The Luer locking means 21 is connecting means, which performs Luer connection concurrently with locking connection (e.g., screw engagement). The Luer locking means used for this purpose generally comprises, for example, a female Luer portion 211 formed by decreasing taperingly a diameter of a lumen L of the mouth 2 according to a shape of a male Luer portion (designated by C1 in FIGS. 4(*a*)–(*c*)) of a needle connecting portion of a syringe, and a male locking portion 212 provided on an outer wall of the mouth 2 for engagement with a female locking portion (designated by C2 in FIG. 4) of the needle connecting portion of the syringe, as illustrated in FIGS. 1–3. As can be seen in FIGS. 1–3, a the male locking portion is tapered and has a diameter adjacent to the container body that is larger than a diameter away from the container body.

Figure 4C:
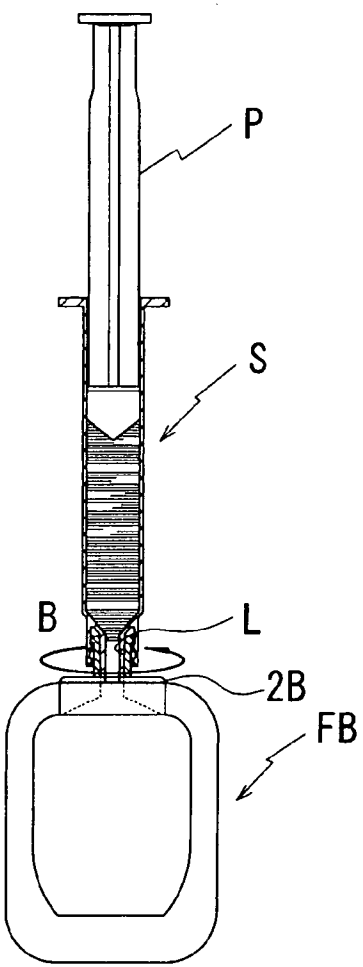
FIGS. 4(*a*)–(*c*) are diagrams illustrating a way to use the bag-shaped drug container of the present invention.
Figure 4B:
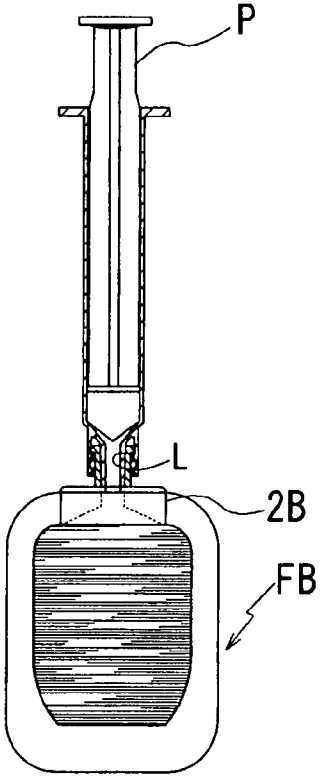
Figure 4A:
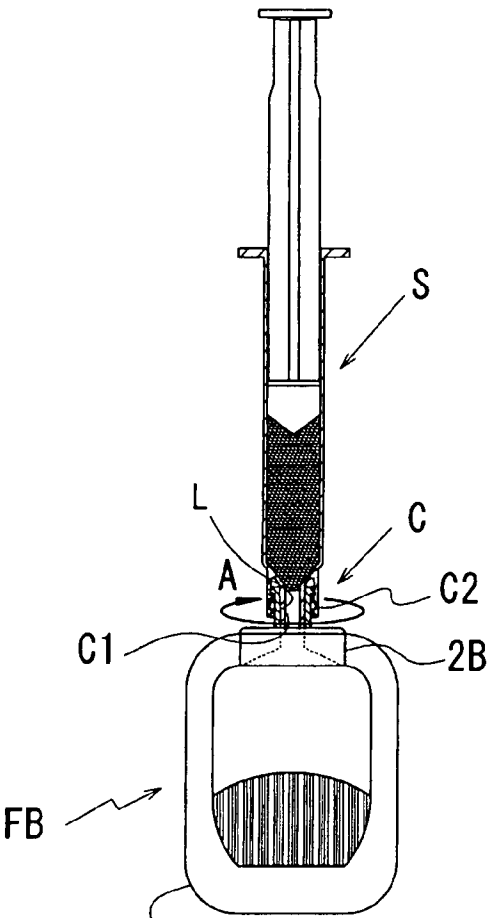

The bag-shaped drug container of the present invention is used in the manner explained below with reference to FIGS. 4(*a*)–(*c*).

Firstly, there are prepared a bag-shaped drug container FB and a Luer locking type syringe provided at a distal end thereof with a Luer locking type needle-connecting portion C (hereinafter referred to as a "tip"). The tip C of the syringe S is fit in the mouth 2 of the drug container FB. Then, the syringe S is turned in the direction indicated by an arrow A for engagement of the tip C with the Luer locking means 21, whereby reliably connecting the syringe S to the mouth 2 of the bag-shaped drug container FB (FIG. 4(*a*)). As illustrated in FIG. 4(*b*), by pressing a plunger P of the Syringe S toward the tip C, a solution in the syringe S is injected into the drug container FB. The container body 1 is then pressed and rubbed with hands to dissolve or suspend the drug in the solution. After complete dissolution or suspension, the resultant drug solution or suspension is drawn into the syringe S by pulling the plunger P away. Then, the syringe S is turned in the direction indicated by an arrow B in FIG. 4(*c*), whereby the tip C is disengaged from the Luer locking means 21. By fitting a hollow needle on the tip C of the syringe S, the syringe S is ready for injection.

As will be understood from the above, the bag-shaped drug container according to the present invention makes it possible to dissolve or suspend the drug in the solution by pressing and rubbing the container body with hands. Further, the syringe is prevented from separation from the drug container during pressing and rubbing operation, thus making it possible to easily and completely dissolve or suspend the drug in the solution even if the drug is almost insoluble or insoluble or even if the dissolution or suspension is carried out with a small amount of solution. In addition, it is possible to minimize foaming of the drug solution during dissolving or suspending operation. Also, it is possible to prevent the working site from being soiled with the drug solution at the time of recovery of the dissolved or suspended solution into the syringe.

What is claimed is:

1. A bag-shaped drug container for use in combination with a syringe having a Luer lock comprising:

a container body shaped as a bag with one open end and made of a flexible film, said container body having a capacity of not more than 10 ml and containing a solid drug almost insoluble or insoluble in a solution that is injected into the container body just before use by a syringe;

a mouth provided at the open end of said body and being liquid-tightly connectable to a tip of the syringe, said mouth comprising a cylindrical portion with inner and outer open ends, and a flattened tubular base portion extending from the inner open end of the cylindrical portion toward the container body, the base portion being connected to the flexible film of the container body to close the open end of the container body, inner and outer walls of the cylindrical portion of the mouth being provided with Luer locking mechanism which concurrently performs both Luer connection and locking connection to the syringe; and a cup-shaped cap removably mounted on the mouth to close the open end of the mouth;

wherein the container body is flexible so as to allow the solid drug contained therein to be dissolved or suspended in the solution by manually pressing and rubbing the container body, and wherein said solution is injected into the container body with the tip of the syringe containing the solution and being liquid-tightly connected to the mouth of the container body.

2. The bag-shaped drug container according to claim 1, wherein said film is a single layer film of polyolefin.

3. The bag-shaped drug container according to claim 1, wherein said film is a multilayer film including an innermost layer of polyolefin.

4. The bag-shaped drug container according to claim 2, wherein said container is packaged in a packaging medium made of an aluminum foil laminated film.

5. The bag-shaped drug container according to claim 3, wherein said film is water permeable and oxygen permeable, and wherein said container is packaged in a packaging medium made of an aluminum foil laminated film.

6. The bag-shaped drug container according to claim 1, wherein said film is a single layer of polyolefin or multilayers including an innermost layer of polyolefin.

7. The bag-shaped drug container, according to claim 1, wherein said container body is made of a front film having water-permeability and oxygen-permeability, and a rear film having water impermeability and oxygen impermeability, and partitioned into first and second chambers by an easily peelable tender sealing portion provided at a position close to a mouth of said container body, said first chamber being communicated with said mouth, while the second chamber is uncommunicated with said mouth, the front film of the second chamber being covered with an easily peelable, water-impermeable and oxygen-impermeable cover film, said second chamber being charged with the almost insoluble or insoluble drug.

8. The bag-shaped drug container according to claim 7, wherein the mouth and the peelable tender sealing portion lie on a longitudinal center line of the container.

9. The bag-shaped drug container according to claim 1, wherein said Luer locking mechanism of the cylindrical portion of the mouth includes a female Luer portion formed by tapering a lumen of the mouth so that the lumen is smaller adjacent to the container body.

10. The bag-shaped drug container according to claim 1, wherein said Luer locking mechanism of the mouth includes a male locking portion formed on the external surface of the cylindrical portion of the mouth.

11. The bag-shaped drug container according to claim 1, wherein said cap is formed with a female locking portion for screw engagement with a male locking portion formed on the external surface of the cylindrical portion of the mouth.

12. The bag-shaped drug container according to claim 1, wherein the lumen of the mouth is inversely tapered to define a female Luer portion for Luer connection to the tip of the syringe, and wherein the outer wall of the cylindrical portion of the mouth is provided with a male thread to define a male locking portion for screw engagement with the tip of the syringe.

13. A bag-shaped drug container for use in combination with a syringe having a Luer lock comprising:

a container body shaped as a bag with one open end and made of a flexible film, said container body having a capacity of not more than 10 ml and containing a solid drug almost insoluble or insoluble in a solution that is injected into the container body just before use by the syringe;

a mouth provided at the open end of said body, said mouth comprising a cylindrical portion with inner and outer open ends, and a flattened tubular base portion extending from the inner open end of the cylindrical portion toward the container body, the base portion being connected to the flexible film of the container body to close the open end of the container body, inner and outer walls of the cylindrical portion of the mouth being provided being provided with Luer locking mechanism which concurrently performs both Luer connection and locking connection to a tip of the syringe and being liquid-tightly connectable to the tip of the syringe; and a cup-shaped cap removably mounted on the mouth to close the open end of the mouth;

wherein the container body is flexible so as to allow the solid drug contained therein to be dissolved or suspended in the solution by manually pressing and rubbing the container body, and wherein said solution is injected into the container body with the tip of the syringe containing the solution and being liquid-tightly connected to the female Luer portion and the male locking portion of the mouth of the container body.

* * * * *